US012188215B2

(12) United States Patent
Ahuja et al.

(10) Patent No.: US 12,188,215 B2
(45) Date of Patent: Jan. 7, 2025

(54) BATHTUB DRAIN STOPPER

(71) Applicant: PF Waterworks LP, Houston, TX (US)

(72) Inventors: Sanjay Ahuja, Katy, TX (US); Harold Kent Beck, Copper Canyon, TX (US)

(73) Assignee: PF Waterworks LP, Houston, TX (US)

( * ) Notice: Subject to any disclaimer, the term of this patent is extended or adjusted under 35 U.S.C. 154(b) by 98 days.

(21) Appl. No.: 17/506,065

(22) Filed: Oct. 20, 2021

(65) Prior Publication Data

US 2022/0042292 A1 Feb. 10, 2022

Related U.S. Application Data

(63) Continuation-in-part of application No. 15/584,032, filed on May 2, 2017, now Pat. No. 11,162,251.

(60) Provisional application No. 63/216,635, filed on Jun. 30, 2021.

(51) Int. Cl.

| | |
|---|---|
| ***E03C 1/262*** | (2006.01) |
| ***A47K 1/14*** | (2006.01) |
| ***E03C 1/23*** | (2006.01) |

(52) U.S. Cl.

CPC ..... *E03C 1/262* (2013.01); *A47K 1/14* (2013.01); *E03C 1/2302* (2013.01); *E03C 1/2306* (2013.01)

(58) Field of Classification Search

CPC ..... A47K 1/14; E03C 1/2306; E03C 1/262

See application file for complete search history.

(56) References Cited

U.S. PATENT DOCUMENTS

| | | | | |
|---|---|---|---|---|
| 1,388,327 | A | 8/1921 | Cornelius | |
| 2,475,048 | A | 7/1949 | Pokras | |
| 2,544,498 | A * | 3/1951 | Hiertz | E03C 1/262 241/46.016 |
| 3,366,980 | A | 2/1968 | Petursson et al. | |
| 3,428,295 | A | 2/1969 | Downey et al. | |
| 4,007,500 | A | 2/1977 | Thompson et al. | |
| 4,381,569 | A * | 5/1983 | Ingram | E03C 1/2306 4/689 |
| 4,597,112 | A | 7/1986 | Cuschera | |
| 6,067,669 | A | 5/2000 | Peterson et al. | |
| 6,490,739 | B1 | 12/2002 | Lee | |
| 8,011,030 | B2 | 9/2011 | Li | |
| 8,499,376 | B2 * | 8/2013 | Kyung Kim | E03C 1/2306 4/689 |
| 8,590,065 | B2 | 11/2013 | Ali et al. | |
| 9,074,358 | B2 * | 7/2015 | Ball | E03C 1/2306 |

(Continued)

OTHER PUBLICATIONS

Keeney Quick "Cover Up" Tub Stopper brochure, The Keeney Manufacturing Company, Newington, CT 2012.

*Primary Examiner* — Janie M Loeppke

(74) *Attorney, Agent, or Firm* — Stephen S. Hodgson

(57) ABSTRACT

A drain stopper assembly that can be simply pushed into and pulled out of a drain pipe includes an open-close mechanism, a cap, a drain seal, and a means for engaging the open-close mechanism with the drain pipe and preferably also includes a strainer. The means includes a wheel-shaped disc that rests on crossbars in the drain pipe and has an annular seal about its perimeter; a ball-and-spring detent mechanism for attaching the drain stopper to crossbars; and a magnet attached to the open-close mechanism, preferably with a ferrous adapter for the drain pipe. The open-close mechanism is a push mechanism, a lift-and-lock mechanism or a lift-and-turn mechanism.

13 Claims, 5 Drawing Sheets

(56) References Cited

U.S. PATENT DOCUMENTS

| | | | | |
|---|---|---|---|---|
| 9,499,962 | B2 * | 11/2016 | Joseph | E03C 1/262 |
| 9,745,728 | B2 | 8/2017 | Beck et al. | |
| 10,240,329 | B2 | 3/2019 | Beck et al. | |
| 10,301,803 | B2 | 5/2019 | Beck et al. | |
| 10,494,800 | B2 | 12/2019 | Ahuja et al. | |
| 2010/0024108 | A1 | 2/2010 | Yang et al. | |
| 2011/0138527 | A1 | 6/2011 | Siena et al. | |
| 2011/0154563 | A1 * | 6/2011 | Ball | E03C 1/262 4/293 |
| 2012/0036624 | A1 | 2/2012 | Laera | |
| 2013/0042398 | A1 | 2/2013 | McLeod | |
| 2013/0125299 | A1 | 5/2013 | Tong | |
| 2013/0180045 | A1 | 7/2013 | Ball et al. | |
| 2013/0269100 | A1 * | 10/2013 | Ball | E03C 1/2306 4/693 |
| 2016/0130793 | A1 | 5/2016 | Lesmeister | |
| 2017/0314245 | A1 | 11/2017 | Beck et al. | |
| 2018/0263426 | A1 | 9/2018 | Ahuja et al. | |
| 2019/0167043 | A1 | 6/2019 | Beck et al. | |
| 2020/0011038 | A1 | 1/2020 | Ahuja et al. | |
| 2021/0207351 | A1 | 7/2021 | Ahuja et al. | |
| 2021/0395986 | A1 | 12/2021 | Ahuja | |

* cited by examiner

FIG.9
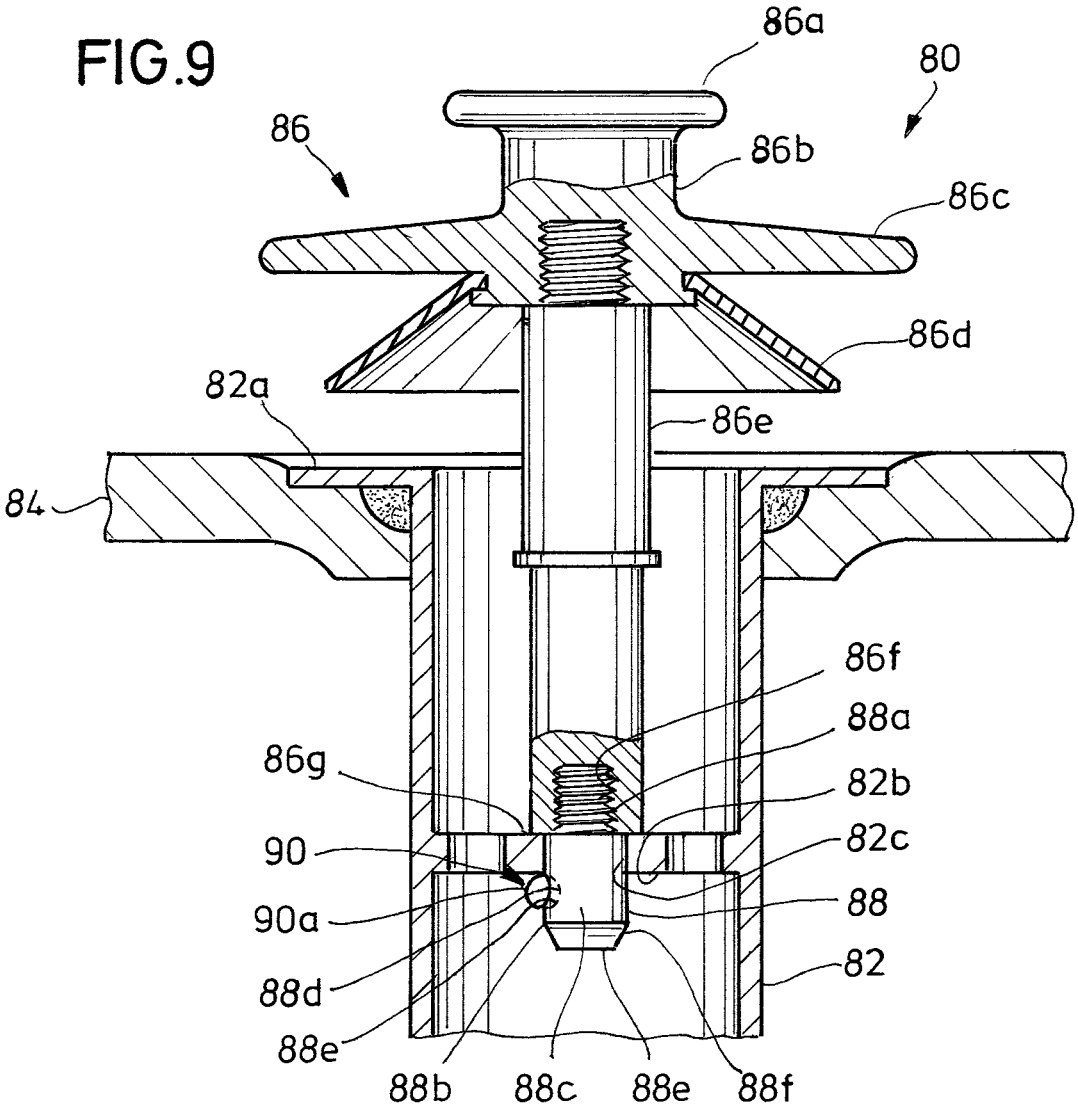
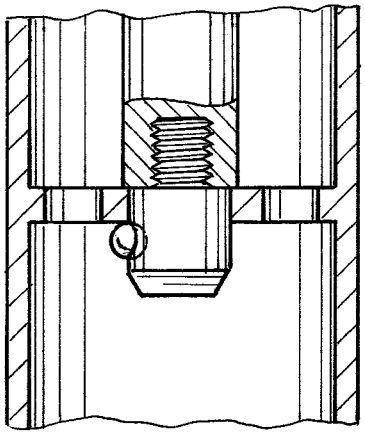
FIG.10

FIG.11
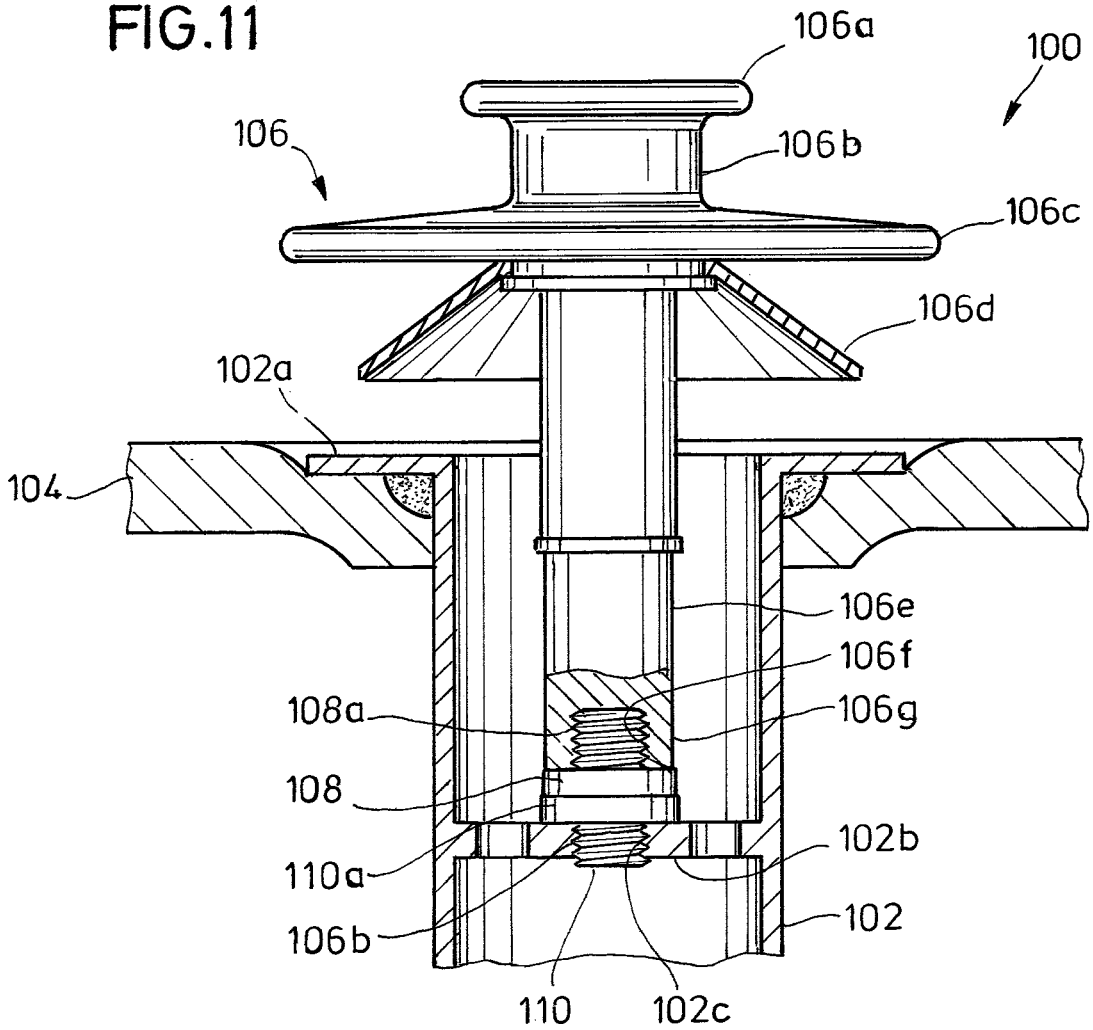
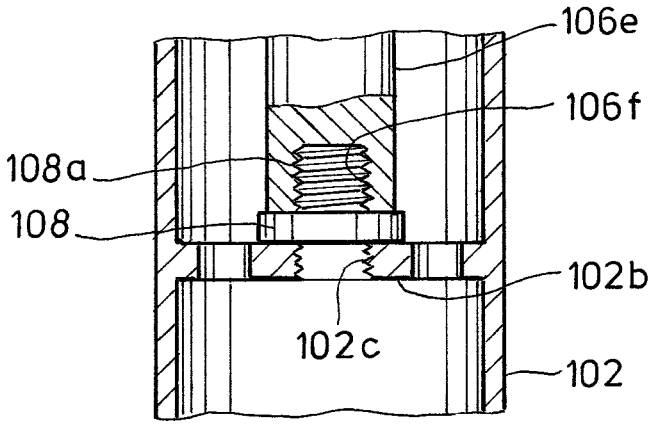
FIG.12

BATHTUB DRAIN STOPPER

CROSS REFERENCE TO RELATED APPLICATIONS

This application is a continuation in part of U.S. patent application Ser. No. 15/584,032 filed on May 2, 2017, which issued as U.S. Pat. No. 11,162,251. This application claims priority to U.S. Provisional Patent Application Ser. No. 63/216,635 filed on Jun. 30, 2021, which is incorporated by reference. U.S. patent application Ser. No. 15/584,030, now U.S. Pat. No. 10,301,803, and Ser. No. 16/558,262 filed on Sep. 2, 2019, are related applications, and each is incorporated by reference.

BACKGROUND OF THE INVENTION

1. Field of the Invention

This present invention pertains to a drain assembly used to retain fluid in and to release fluid from a bathtub or a sink and more particularly to a push-in, pull-out drain stopper assembly for a bathtub or a sink.

2. Description of the Related Art

There are a number of types of drain systems or assemblies for retaining water in and then draining water from a bathtub. A drain pipe is sealed in a drain opening using a drain flange that is sealed to the bathtub around the opening. A drain pipe for a bathtub typically has a 90-degree bend, which gives the drain pipe the appearance of a shoe, so a drain pipe for a bathtub is often referred to as a tub shoe. The drain pipe will often, but not always, have a member inside called a crossbar. A crossbar is generally a set of two bars crossed, which divide the drain opening into four pie-shaped openings. One type of crossbar has a threaded opening in the center and another does not. U.S. Pat. No. 3,428,295, issued to Downey et al., describes a push-actuated drain valve, which is anchored to a crossbar that has a threaded opening. U.S. Pat. No. 4,007,500, issued to Thompson et al., describes a different push-type drain stopper for a bathtub, which is also anchored by a bolt threaded into a central threaded opening in a bathtub drain crossbar. U.S. Pat. No. 9,518,383, issued to Lesmeister, discloses a drop-in bathtub drain stopper assembly having a strainer basket with a radially-extending flange on an upper end that rests on a drain flange in a bathtub. A magnet holds the drain stopper in an open position.

SUMMARY OF THE INVENTION

A push-in, pull-out drain stopper assembly is provided for a bathtub or a sink having a drain hole and a drain pipe having a drain flange attached to the bathtub or sink at the drain opening, where the drain pipe may or may not have crossbars for anchoring the drain stopper, where the crossbars may or may not have a central opening, and where the central opening may have one of more than one size. The drain stopper includes an open-close mechanism having a longitudinal axis, upper and lower ends, a distance between the upper and lower ends and an open position and a closed position, where the open-close mechanism is a push mechanism, a lift-and-lock mechanism or a lift-and-turn mechanism, and where the distance between the upper end and the lower end differs between the open position and the closed position; a cap engaged with the upper end of the open-close mechanism; a drain seal engaged with the cap or the open-close mechanism for retaining water in the bathtub or the sink while the open-close mechanism is in the closed position; preferably a strainer surrounding the open-close mechanism, wherein the strainer is entirely inside the drain pipe while in operation; and means for engaging the open-close mechanism with the drain pipe, where the means is secured to or formed integral with the lower end of the open-close mechanism.

The open-close mechanism, the cap, the drain seal, the strainer and the means for engaging the open-close mechanism with the drain flange form a unitary assembly while assembled, wherein the unitary assembly has a longitudinal axis that is coaxial with the longitudinal axis of the open-close mechanism at all times while assembled, wherein the unitary assembly is radially symmetrical about the longitudinal axis of the open-close mechanism at all times while assembled, and wherein the means for engaging the open-close mechanism with the drain pipe is designed and configured to allow a user to push the unitary assembly into the drain pipe and to pull the unitary assembly out of the drain pipe. The unitary assembly is not fixed to the drain pipe such as by a threaded connection or by a pivot rod protruding into the drain pipe and into an aperture in the drain stopper assembly. The unitary assembly is not threadedly engaged with the drain pipe, and a user can pull the unitary assembly out of the drain pipe without rotating the unitary assembly or any portion of the unitary assembly.

In a first embodiment, the means for engaging the open-close mechanism with the drain pipe comprises a wheel-shaped disc and an annular seal engaged with the disc, where the disc is designed and configured to rest on the crossbars in the drain pipe without attachment to the crossbars. In a second embodiment, the means for engaging the open-close mechanism with the drain pipe comprises a ball-and-spring detent mechanism attached to or formed integral with the lower end of the open-close mechanism, where the ball-and-spring detent mechanism is designed and configured to pass through a central opening in crossbars in the drain pipe. In a third embodiment, the means for engaging the open-close mechanism with the drain pipe comprises a magnet that is designed and configured so that the drain stopper is engaged with the crossbars or a rod in the drain pipe through magnetic attraction. Preferably, the open-close mechanism has a bore defined by interior threads on its lower end; the magnet comprises a shank and a head attached to the shank, where the shank has exterior threads engaged with the interior threads, and where the head is a magnet or is ferrous in which case an adapter is provided for the drain pipe to provide a magnetic attraction.

A drain stopper for a bathtub having a drain opening and a drain pipe having a drain flange attached to the bathtub at the drain opening is described, which includes: an open-close mechanism having upper and lower ends, wherein the open-close mechanism is a push-push mechanism, lift-and-lock mechanism or a lift-and-turn mechanism, wherein the upper and lower ends have threads, and wherein the upper end has male threads; a cap having a bore with female threads, wherein the upper end of the open-close mechanism is received in the bore of the cap in a threaded engagement; a cap seal engaged with the cap for providing a seal with the drain flange or the drain pipe; means for anchoring the open-close mechanism in the drain pipe, wherein the lower end of the open-close mechanism is in threaded engagement with the means for anchoring, wherein the drain stopper has a length between the cap and the means for anchoring, and wherein the length can be adjusted by the amount that the upper end of the push mechanism is screwed into the bore in the cap; and preferably, a lock nut having female threads received on and in threaded engagement with the upper end of the open-close mechanism, wherein the lock nut is in a tight friction abutment with the cap for holding the length of the drain stopper constant.

The means for anchoring the open-close mechanism in the drain pipe is preferably selected from the group consisting of: male threads on the lower end of the push mechanism for threading into a tub shoe that has cross bars with an opening defined by female threads; an anchor comprising a base and a set of prongs, wherein the base is in threaded engagement with the lower end of the open-close mechanism, and wherein the prongs have a catch mechanism for engaging a tub shoe that has cross bars without a threaded opening; a wheel-shaped circular body having a groove along its perimeter and an O-ring received in the groove, wherein the body has openings for allowing water to pass through the body, and wherein the body and the O-ring are designed and sized for a friction engagement in a drain pipe that does not have a crossbar; a disc designed to rest on the crossbars for holding the drain stopper in the drain pipe, a ball-and-spring detent mechanism designed to engage the drain stopper with the crossbars and a magnet designed to engage the drain stopper with the crossbars. In one embodiment, the cap has a diameter at its widest point, wherein the cap seal has a diameter at its widest point, and wherein the diameter of the cap is 10 to 50 percent, preferably 20 to 40 percent, greater than the diameter of the seal. In another embodiment, a strainer surrounds the open-close mechanism.

BRIEF DESCRIPTION OF THE DRAWINGS

A better understanding of the invention can be obtained when the detailed description of exemplary embodiments set forth below is considered in conjunction with the attached drawings in which:

FIG. 9 is a side elevation in partial cross-section of a drain stopper assembly, according to the present invention;

FIG. 10 is a side elevation in partial cross-section of the lower end of the drain stopper assembly of FIG. 9, except having a different size.

FIG. 11 is a side elevation in partial cross-section of a drain stopper assembly, according to the present invention;

FIG. 12 is a side elevation in partial cross-section of the lower end of the drain stopper assembly of FIG. 11, except having a different size.

DETAILED DESCRIPTION OF THE EXEMPLARY EMBODIMENTS

Figure 2:
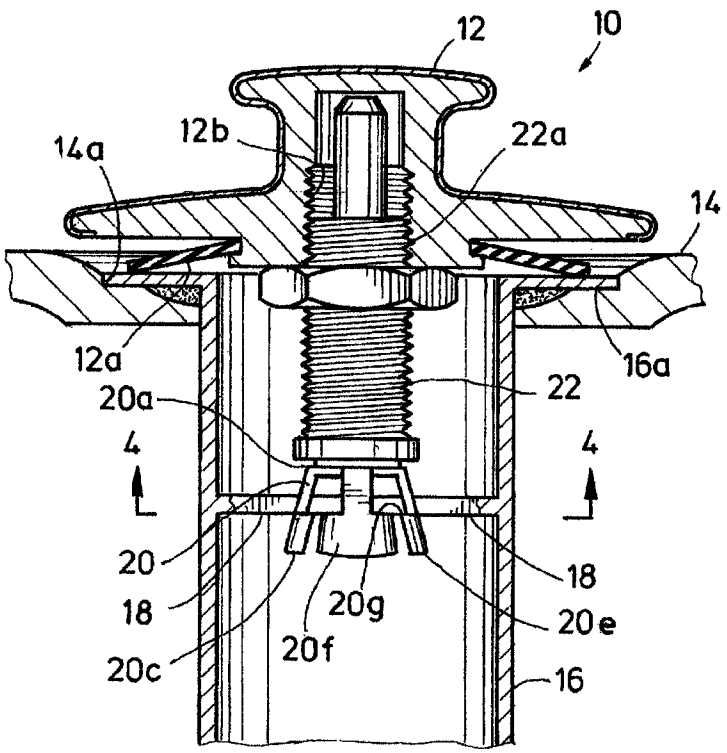
FIG. 2 is a side elevation in partial cross-section of the bathtub drain stopper of FIG. 1 in a closed position.
Figure 1:
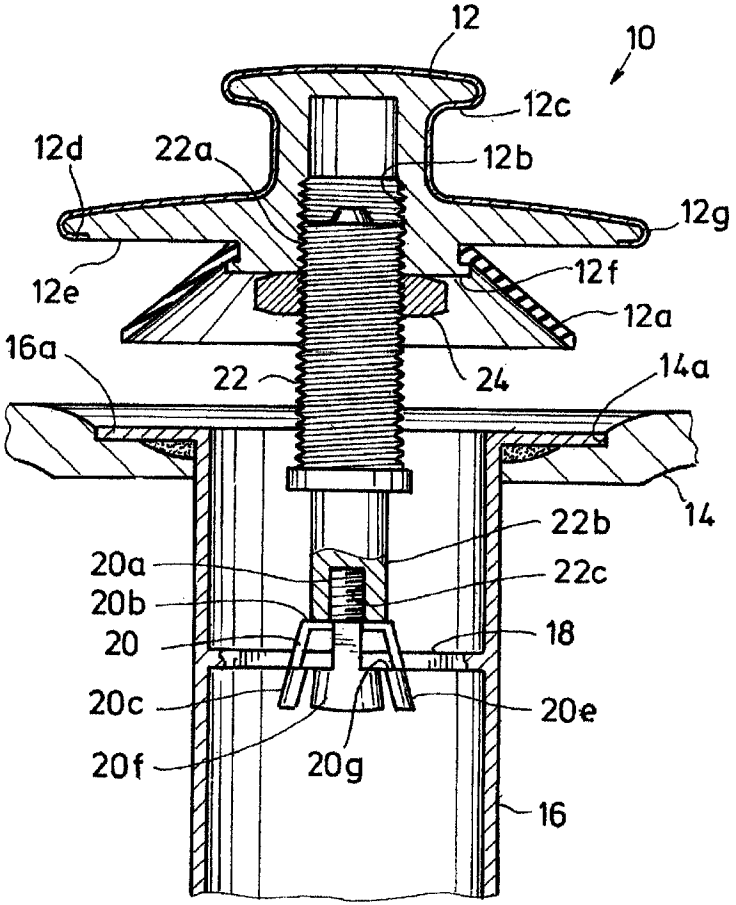
FIG. 1 is a side elevation in partial cross-section of a bathtub drain stopper in an open position, according to the present invention.
Figure 4:
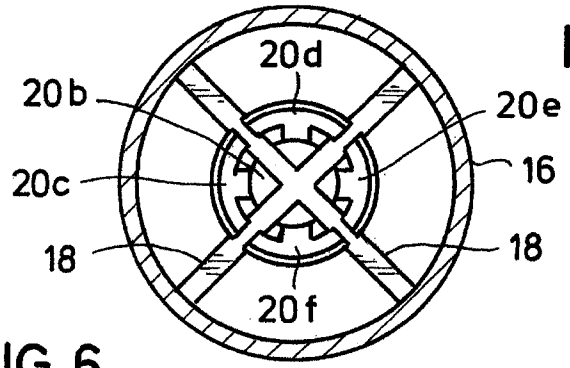
FIG. 4 is a plan view of the bathtub drain stopper of FIG. 2 as seen along the line 4-4.

FIG. 1 is a side elevation in partial cross-section of a push-type bathtub drain stopper 10 in an open position. FIG. 2 shows the drain stopper 10 in a closed position. Stopper 10 has a cap 12 and a gasket or seal 12*a*. A bathtub or a sink 14 has a drain opening 14*a*. A drain pipe 16 has a drain flange 16*a* sealed against the tub 14 at the drain opening 14*a*. FIG. 4 is a cross-section of the drain pipe 16 as seen along the line 4-4 in FIG. 2. FIG. 4 shows a plan view of a crossbar 18. Crossbar 18 does not have a threaded opening. Crossbar 18 is a set of two crossed bars. An anchor 20 is used to fasten drain stopper 10 to crossbar 18. Anchor 20 has a threaded stud 20*a* that projects upwardly toward the main body of drain stopper 10 from a base plate 20*b*. Anchor 20 has four prongs 20*c*, 20*d*, 20*e* and 20*f* that project downwardly from the base plate 20*b*. Each of the prongs has the shape of a garden spade, where a handle or shaft portion connects to the base plate 20*b* and terminates in a flat and generally rectangular head at a distal end. A shoulder 20*g* is defined where the narrow shaft portion transitions into the wide head portion. The head portions of the prongs of anchor 20 pass through and slightly beyond the cross bar 18, and the shoulders 20*g* catch on the cross bars and anchor drain stopper 10 to the crossbar 18.

Drain stopper 10 has a push mechanism 22 such as described in U.S. Pat. Nos. 3,428,295 and 4,007,500. A push downward on the open stopper in FIG. 1 closes the stopper, and a downward push on the closed stopper in FIG. 2 causes the stopper to move into the open position. Push mechanism 22 has an upper end 22*a* and a lower end 22*b*. The lower end 22*b* has a central longitudinal bore 22*c* that is defined by female threads. The stud 20*a* of anchor 20 is threaded into the bore 22*c* of the push mechanism 22, which connects the push mechanism 22 to the crossbar 18. Drain stopper 10 can be used in different drain pipes, where the distance between the tub shoe and the top of the drain flange varies. Cap 12 has a central longitudinal bore 12*b* defined by female threads, and the push mechanism 22 has male threads at its upper end 22*a*. The upper end 22*a* of the push mechanism 22 is received in the bore 12*b* of the cap 12. The amount that the push mechanism 22 is threaded into the bore 12*b* provides a way for adjusting the push mechanism to fit different distances between the crossbar and the top of the drain flange. After the push mechanism 22 is threaded into the bore 12*b* a desired amount to accommodate a particular distance or height, a lock nut 24 is tightened against a bottom surface of the cap 12 to maintain the desired length between the cap 12 and the crossbar 18.

The cap 12 has a diameter that is greater than the diameter of the drain flange 16*a*. The purpose of this is to hide the drain flange 16*a* from view, possibly because the finish on the drain flange 16*a* has become damaged or worn and is unsightly or because one wishes to change the finish color, such as from polished brass to chrome. Cap 12 has a grip portion 12*c* and a decorative cover 12*d* that covers all of an upper surface of a body 12*e*. The body 12*e* may alternatively have a dome shape without the grip portion 12*c*. The body 12*e* has a cylinder 12*f* located centrally and projecting downwardly. The cylinder 12*f* has a circumferential groove, and the seal 12*a* is seated in the groove. The lock nut 24 tightens against the cylinder 12*f*. Cap 12 has a greatest diameter D at an outermost edge 12*g* where the decorative cover 12*d* begins to fold inwardly and wrap under a flanged portion of the body 12*e*. In order for the cap 12 to serve the purpose of covering the drain flange 16*a*, the diameter D of the cap 12 should be equal to or greater than the diameter of the drain flange 16*a*. In one instance the diameter of the drain flange 16*a* may be 2.75 inches, so the diameter D of the cap 12 should be 2.75 inches or greater, preferably 3.0 to 3.5 inches in diameter. The seal 12*a* should rest on and seal against the drain flange 16*a*. The diameter D of the cap 12 should be greater than the diameter of the seal 12*a* at its widest point in order for the decorative cover 12*d* to cover and hide the drain flange 16*a*. The diameter D of the cap 12 may be 10 to 50, preferably 20 to 40, percent greater than the diameter of the seal 12*a*. If the seal fits inside the drain pipe and seals against an inside wall of the drain pipe, then the diameter D may need to be 50 to 75 percent greater that the diameter of the seal. However, it is generally satisfactory to use a smaller cap of a standard size, which does not cover the drain flange.

Figure 7:
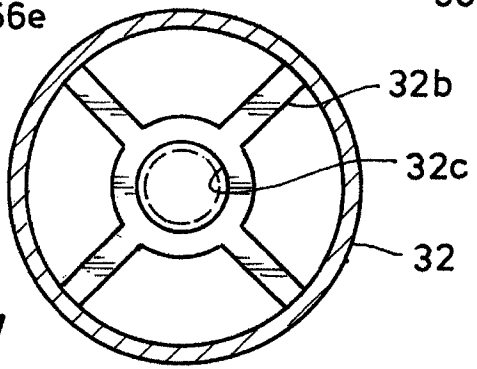
FIG. 7 is a plan view of the anchor system of FIG. 3 as seen along the line 7-7.
Figure 3:
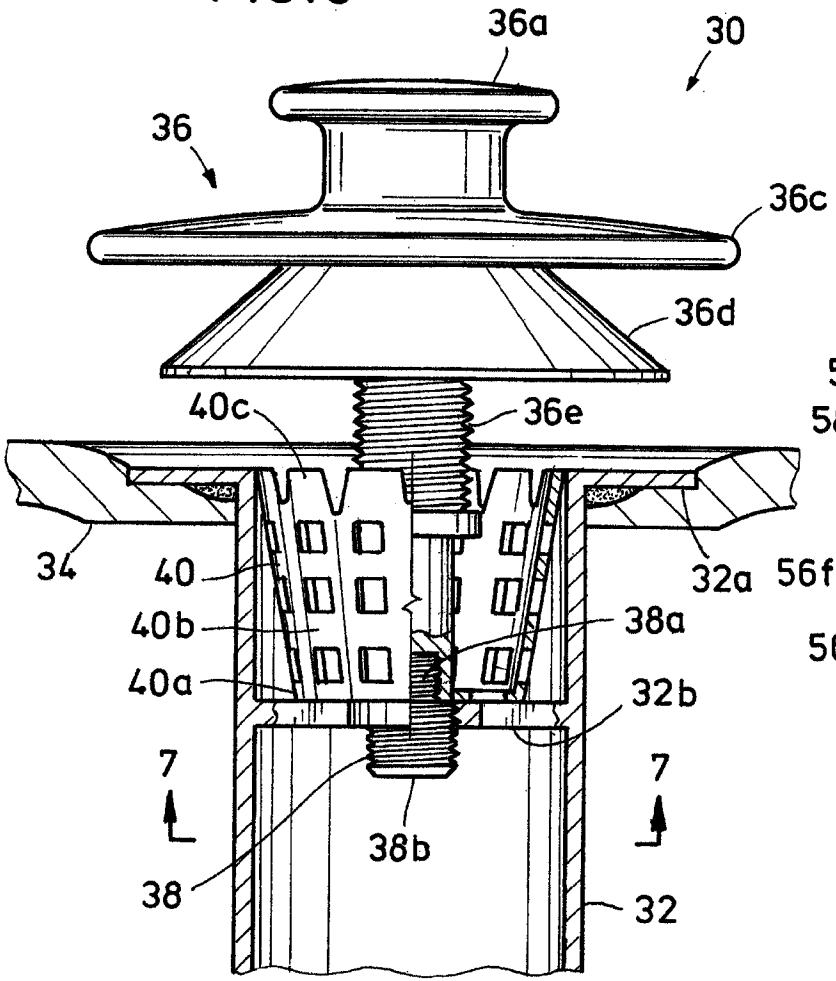
FIG. 3 is a side elevation in partial cross-section of a bathtub drain assembly, according to the present invention.

FIG. 3 is a side elevation in partial cross-section of a bathtub drain assembly 30, which is made and used as described with reference to FIGS. 1 and 2, except anchored differently to a different tub shoe and having a strainer. A drain pipe 32 has a drain flange 32*a* sealed about a drain opening in a bathtub 34. A crossbar 32*b* is fixed inside the drain pipe 32. FIG. 7 is a cross-section of the drain pipe 32 as seen along the line 7-7 in FIG. 3. The crossbar 32*b* has a central threaded opening 32*c*. A drain stopper 36 includes a cap 36*a*, which has a grip portion 36*b*, a large and decorative drain cover 36*c*, a seal 36*d*, which seals against the drain flange 32*a*, a push mechanism 36*e* and a lock nut 36*f* as shown in FIG. 1, but not visible in FIG. 3. The push mechanism 36*e* has the same male threads on an upper end and is threaded into the cap for adjusting height in the same manner as described for the stopper 10 in FIG. 1. The push mechanism 36*e* also has the same threaded bore at its lower end as the bore 22*c* in FIG. 1. An anchor element 38 is a threaded rod that has an upper end 38*a* and a lower end 38*b*. The upper end 38*a* has male threads and is sized to screw into the threaded bore in the lower end of the push mechanism 36*e*. The lower end 38*b* of the anchor element 38 has male threads and is sized to thread into the threaded opening 32*c* of the crossbar 32*b*.

The anchor element 38 thus anchors the push mechanism 36*e* to the crossbar 32*b* in the drain pipe 32 because the upper end 38*a* is in threaded engagement with the push mechanism 36*e* and the lower end 38*b* is in threaded engagement with the crossbar 32*b*. The anchor element 38 can be made to have different diameters for its upper and lower ends for attachment to crossbars that have a threaded opening of different sizes and to accommodate a push mechanism that has a threaded bore of a different size. A kit can be assembled and sold that has a drain stopper with a push mechanism and several all-thread anchors, which each have an upper end that threads into a threaded bore in the push mechanism, but each has a different diameter for its lower end to fit into different tub shoes that have crossbars with threaded openings of different sizes. The four-prong anchor 20 of FIG. 1 can be included in the kit for attachment to a tub shoe that has a cross bar but no threaded opening.

A strainer basket 40 is received in the drain pipe 32 above the crossbar 32*b* and surrounds the push mechanism 36*e*. The strainer basket has a circular, annular, washer-shaped base 40*a* that has a central opening through which the push mechanism 36*e* passes. The base 40*a* rests on the crossbar 32*b*. Strainer 40 has a side wall 40*b* and an open upper end 40*c*. The open upper end 40*c* has a diameter that is greater than the diameter of the base 40*a*. Consequently, the side wall 40*b* of the strainer basket 40 flares outwardly from the base 40*a* to the upper end 40*c*, which gives the side wall 40*b* a conical shape. The upper end has V-shaped notches made in and pointing into the side wall 40*b*. The side wall 40*b* and the base 40*a* of the strainer 40 have a plurality of openings through which water can pass. A strainer basket can also be used with the drain stopper 10 in FIG. 1. Strainers typically have the shape of a basket, such as shown in FIG. 3. An alternative strainer is a perforated disc that has holes or slots, which is inserted into a drain pipe to catch hair or objects. A perforated-disc strainer can also function as a universal adapter that will work in drains that do not have a threaded connector with the addition of a restraining element.

Figure 5:
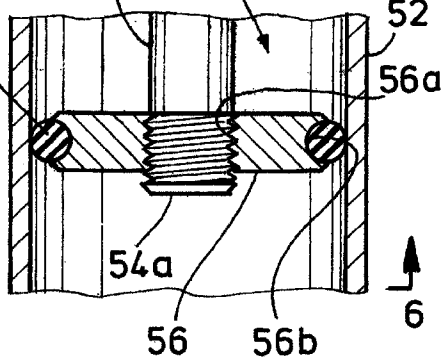
FIG. 5 is a side elevation in cross-section of an anchor system for a bathtub drain stopper, according to the present invention.
Figure 6:
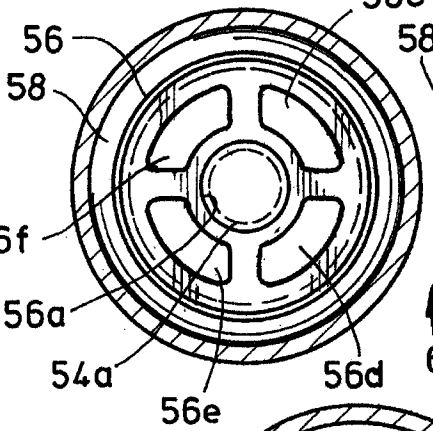
FIG. 6 is a plan view of the anchor system of FIG. 5 as seen along the line 6-6.

FIG. 5 is a side elevation in cross-section of an anchor system 50 for a drain pipe 52 that does not have a cross bar. A push mechanism 54 has a threaded lower end 54*a*. A disc 56 has a central threaded bore 56*a* and is threaded onto the lower end 54*a* of the push mechanism. FIG. 6 is a view of the disc 56 as seen along the line 6-6 in FIG. 5. Disc 56 has the shape of a wheel with a circumferential groove 56*b* along its outer perimeter. An O-ring 58 is received in the groove 56*b*. The disc 56 is pressed into the drain pipe 52, and the O-ring 58 provides friction against an inside wall of the drain pipe 52 for anchoring the disc 56 and the push mechanism 54 in the drain pipe 52. The drain pipe 52 has a longitudinal axis that is coaxial with the flow path of water draining through the drain pipe. The disc 56 is oriented transverse, perpendicular, to the longitudinal axis of the drain pipe 52. Disc 56 has openings 56*c*, 56*d*, 56*e* and 56*f* through which water can flow and drain.

Some drain stoppers for bathtubs are referred to as toe touch, lift and lock and lift and turn. The push mechanism described above is referred to as the toe touch since a push on the top of the stopper will change the position of the stopper from open to closed or from closed to open. The larger-than-normal drain cap for covering a drain flange can also be used with a lift and lock stopper and with a lift and turn stopper. The anchoring systems described above, namely the multiple-prong anchor, the all-thread rod having one diameter to fit the open-close mechanism and another diameter to fit an opening in a crossbar, and the wheel-shaped disc with an O-ring to seal against an inside wall of a drain pipe, can also be used with a lift and lock stopper and with a lift and turn stopper. The strainer basket can be used with any of the anchoring systems described above and also with a lift and lock stopper and with a lift and turn stopper, with or without a large drain-covering cap.

Turning now to the continuation-in-part portion of this application, the applicant first states the embodiments of the invention that were claimed in the original application, which were set forth as follows.

1. A drain stopper for a bathtub having a drain opening and a drain pipe having a drain flange attached to the bathtub at the drain opening, comprising:
   - a push mechanism having upper and lower ends, wherein the upper and lower ends have threads, and wherein the upper end has male threads;
   - a cap having a bore with female threads, wherein the upper end of the push mechanism is received in the bore of the cap in a threaded engagement;
   - a seal engaged with the cap for providing a seal with the drain flange or the drain pipe;
   - means for anchoring the push mechanism in the drain pipe, wherein the lower end of the push mechanism is in threaded engagement with the means for anchoring, wherein
   - the drain stopper has a length between the cap and the means for anchoring, and wherein the length can be adjusted by the amount that the upper end of the push mechanism is screwed into the bore in the cap; and a lock nut having female threads received on and in threaded engagement with the upper end of the push mechanism, wherein the lock nut is in a tight friction abutment with the cap for holding the length of the drain stopper constant.

2. The drain stopper of embodiment 1, wherein the means for anchoring the push mechanism in the drain pipe is selected from the group consisting of:

male threads on the lower end of the push mechanism for threading into a tub shoe that has cross bars with an opening defined by female threads;

an anchor comprising a base and a set of prongs, wherein the base is in threaded engagement with the lower end of the push mechanism, and wherein the prongs have a catch mechanism for engaging a tub shoe that has cross bars without a threaded opening; and a wheel-shaped circular body having a groove along its perimeter and an O-ring received in the groove, wherein the body has openings for allowing water to pass through the body, and wherein the body and the O-ring are designed and sized for a friction engagement in a drain pipe that does not have a tub shoe.

3. The drain stopper of embodiment 2, wherein the cap has a diameter at its widest point, wherein the seal has a diameter at its widest point, and wherein the diameter of the cap is 10 to 50 percent greater than the diameter of the seal. 4. The drain stopper of embodiment 3, wherein the diameter of the cap is 20 to 40 percent greater than the diameter of the seal. 5. The drain stopper of embodiment 2, further comprising a strainer basket surrounding the push mechanism. 6. The drain stopper of embodiment 4, further comprising a strainer basket surrounding the push mechanism.

7. A drain stopper for a bathtub having a drain opening and a drain pipe having a drain flange attached to the bathtub at the drain opening, comprising:

an open-close mechanism having upper and lower ends, wherein the open-close mechanism is a lift-and-lock mechanism or a lift-and-turn mechanism, wherein the upper and lower ends have threads, and wherein the upper end has male threads;

a cap having a bore with female threads, wherein the upper end of the push mechanism is received in the bore of the cap in a threaded engagement;

a seal engaged with the cap for providing a seal with the drain flange or the drain pipe;

means for anchoring the open-close mechanism in the drain pipe, wherein the lower end of the push mechanism is in threaded engagement with the means for anchoring, wherein the drain stopper has a length between the cap and the means for anchoring, and wherein the length can be adjusted by the amount that the upper end of the push mechanism is screwed into the bore in the cap; and a lock nut having female threads received on and in threaded engagement with the upper end of the push mechanism, wherein the lock nut is in a tight friction abutment with the cap for holding the length of the drain stopper constant.

8. The drain stopper of embodiment 7, wherein the means for anchoring the open-close mechanism in the drain pipe is selected from the group consisting of:

male threads on the lower end of the push mechanism for threading into a tub shoe that has cross bars with an opening defined by female threads;

an anchor comprising a base and a set of prongs, wherein the base is in threaded engagement with the lower end of the open-close mechanism, and wherein the prongs have a catch mechanism for engaging a tub shoe that has cross bars without a threaded opening; and a wheel-shaped circular body having a groove along its perimeter and an O-ring received in the groove, wherein the body has openings for allowing water to pass through the body, and wherein the body and the O-ring are designed and sized for a friction engagement in a drain pipe that does not have a tub shoe.

9. The drain stopper of embodiment 8, wherein the cap has a diameter at its widest point, wherein the seal has a diameter at its widest point, and wherein the diameter of the cap is 10 to 50 percent greater than the diameter of the seal. 10. The drain stopper of embodiment 9, wherein the diameter of the cap is 20 to 40 percent greater than the diameter of the seal. 11. The drain stopper of embodiment 8, further comprising a strainer basket surrounding the push mechanism. 12. The drain stopper of embodiment 10, further comprising a strainer basket surrounding the push mechanism.

FIG. 5 in the original application was described in a paragraph above as follows. FIG. 5 is a side elevation in cross-section of an anchor system 50 for a drain pipe 52 that does not have a cross bar. A push mechanism 54 has a threaded lower end 54*a*. A disc 56 has a central threaded bore 56*a* and is threaded onto the lower end 54*a* of the push mechanism. FIG. 6 is a view of the disc 56 as seen along the line 6-6 in FIG. 5. Disc 56 has the shape of a wheel with a circumferential groove 56*b* along its outer perimeter. An O-ring 58 is received in the groove 56*b*. The disc 56 is pressed into the drain pipe 52, and the O-ring 58 provides friction against an inside wall of the drain pipe 52 for anchoring the disc 56 and the push mechanism 54 in the drain pipe 52. The drain pipe 52 has a longitudinal axis that is coaxial with the flow path of water draining through the drain pipe. The disc 56 is oriented transverse, perpendicular, to the longitudinal axis of the drain pipe 52. Disc 56 has openings 56*c*, 56*d*, 56*e* and 56*f* through which water can flow and drain.

The original application also stated the following in a paragraph above. The anchoring systems described above, namely the multiple-prong anchor, the all-thread rod having one diameter to fit the open-close mechanism and another diameter to fit an opening in a crossbar, and the wheel-shaped disc with an O-ring to seal against an inside wall of a drain pipe, can also be used with a lift and lock stopper and with a lift and turn stopper. The strainer basket can be used with any of the anchoring systems described above and also with a lift and lock stopper and with a lift and turn stopper, with or without a large drain-covering cap.

With reference to FIG. 1, the original application stated the following in a paragraph above. The upper end 22*a* of the push mechanism 22 is received in the bore 12*b* of the cap 12. The amount that the push mechanism 22 is threaded into the bore 12*b* provides a way for adjusting the push mechanism to fit different distances between the crossbar and the top of the drain flange. After the push mechanism 22 is threaded into the bore 12*b* a desired amount to accommodate a particular distance or height, a lock nut 24 is tightened against a bottom surface of the cap 12 to maintain the desired length between the cap 12 and the crossbar 18.

One embodiment of the invention is a drain stopper that has an adjustable length. Different manufacturers make drain pipes, tub shoes and drain flanges that have crossbars, where the distance between the crossbars and the top of the drain is often different. The push mechanism 22 is threaded into the bore 12*b* a desired amount to accommodate for these differences in distance or height. The lock nut 24 is tightened against the bottom surface of the cap 12 to maintain the desired length between the cap 12 and the crossbar 18. An adjustable length is not needed for the embodiment of the invention described for FIG. 5 when there are no crossbars in a drain pipe, tub shoe or drain flange in applications where the embodiment of FIG. 5 is used. Consequently, the lock nut 24 described with reference to FIG. 1 is not necessarily needed for the embodiment described with reference to FIG. 5, although the use of a lock nut is optional. The embodiment of the invention described for FIG. 5 can be used in a drain pipe that has crossbars in which case the adjustable-length feature is desirable.

The description for FIG. 5 states that the push mechanism 54 has a threaded lower end 54*a*; the disc 56 has a central threaded bore 56*a* that is threaded onto the lower end 54*a* of the push mechanism; the disc 56 is pressed into the drain pipe 52; and the O-ring 58 provides friction against an inside wall of the drain pipe 52 for anchoring the disc 56 and the push mechanism 54 in the drain pipe 52. A plumber who receives a kit with a cap 12, a cap seal 12*a*, an open-close mechanism 54, a disc 56, a drain seal 58 and this description for FIG. 5 would assemble a drain stopper and press it into a drain pipe far enough for the cap seal to retain water in a bathtub while in its closed position and to allow water to drain while in its open position. The plumber or another person would be able to pull the drain stopper out of the drain pipe as easily as the plumber had pushed the drain stopper into the drain pipe. When the plumber assembled these parts, he or she would form a unitary assembly, a drain stopper, which was made by connecting components together to form a single thing. The drain stopper may be sold as a kit with the components for making the drain stopper or as a pre-assembled drain stopper. In either case, a drain stopper is provided that is a unitary assembly that can be pushed into and pulled out of a drain pipe.

Having a drain stopper that is a unitary assembly that can be pushed into and pulled out of a drain pipe is useful when a drain pipe does not have crossbars. It is also particularly useful if the drain stopper also has a strainer for catching hair, debris and objects because the fully-assembled drain stopper can be easily pulled out of the drain pipe to clean the strainer. Since the drain stopper of FIG. 5 is not attached to crossbars, which are generally provided in a bathtub drain pipe, or to a pivot rod, which is generally provided in a bathroom sink that has a pop-up drain stopper with a control rod for opening and closing a drain stopper, no disassembly is required before pulling the drain stopper of FIG. 5 out of a drain pipe. The disc 56 in FIGS. 5 and 6 can have holes that allow water to drain through while not tending to allow hair, debris and objects to pass through the holes in which case the drain stopper would include a perforated-disc strainer. Alternatively, the strainer basket 40 of FIG. 3 can be included with the kit of parts that the plumber assembles to make the unitary drain stopper, and he or she may choose to place the strainer basket so as to trap hair, debris and objects inside the strainer basket as shown in FIG. 3 or in a reverse orientation so as to trap hair, debris and objects on an outside surface of the strainer basket. The strainer basket works in both orientations. The strainer of the present invention is assembled along with other components to form a drain stopper. While the drain stopper is assembled with a strainer and in operation in a drain pipe, the strainer is within the drain pipe as opposed to above the drain pipe and resting on an upper drain flange such as the drain flange 32*a* on the upper end of the drain pipe 32 in FIG. 3. Prior art strainers are often located on an upper surface of a drain flange such as on an upper surface of the drain flange 32*a* in FIG. 3, while the strainer of the present invention is part of the drain stopper assembly that is down in the drain pipe below the drain flange that seals against a bathtub or sink. The strainers of the present invention are not visible while the drain stopper of the present invention is installed in a drain pipe. The strainers of the present invention are not a screen that lies on an upper surface of a drain flange, such as the drain flange 32*a* in FIG. 3. In all of these alternative embodiments of a drain stopper with straining capability, the fully-assembled drain stopper and strainer can be pushed into a drain pipe as a unitary assembly and can be pulled out of the drain pipe without any disassembly required. Removal of a drain stopper often requires disassembly, such as unthreading from a set of crossbars that have a central hub with threads in a bathtub drain pipe or removing a pivot rod in order to pull a drain stopper out of a bathroom sink. No such disassembly is required for the drain stopper described with reference to FIG. 5.

The O-ring 58 or another type of drain seal prevents water from draining through an annular space between the disc 56 and an inside surface of a drain pipe, thereby forcing water to drain through the strainer. The drain seal also serves the purpose of holding the drain stopper in a desired position for proper operation of the open-close mechanism, where the drain seal provides a friction fit or an interference fit between the disc 56 and an inside surface of a drain pipe. For use in a drain pipe that does not have crossbars, the drain stopper, particularly the drain seal, should be designed and configured to provide the proper friction or interference fit for the drain stopper to be pushed into and pulled out of the drain pipe while at the same time providing sufficient gripping capability to hold the drain stopper in a fixed position in a drain pipe as the open-close mechanism is repeatedly cycled through opening and closing motions. Easy removal of the drain stopper from the drain pipe allows one to easily clean or replace a strainer, without any need to disassemble or unthread the drain stopper from the drain pipe.

The description of FIG. 5 states that the drain pipe 52 has a longitudinal axis that is coaxial with the flow path of water draining through the drain pipe, and the disc 56 is oriented transverse, perpendicular, to the longitudinal axis of the drain pipe 52. With reference to FIGS. 1-3 and 5, if the disc 56 is perpendicular to the longitudinal axis of the drain pipe, then the longitudinal axis of the open-close mechanism is coaxial with the longitudinal axis of the drain pipe since "disc 56 has a central threaded bore 56*a* and is threaded onto the lower end 54*a* of the push mechanism," as stated in the description for FIG. 5. The description of FIG. 1 states that the cap 12 has a central longitudinal bore 12*b* defined by female threads, and the push mechanism 22 has male threads at its upper end 22*a*. The upper end 22*a* of the push mechanism 22 is received in the bore 12*b* of the cap 12. The cap, cap seal, strainer, disc and drain seal are all radially symmetrical about the longitudinal axis of the open-close mechanism while assembled and, therefore, have a common longitudinal axis while assembled. A fully-assembled drain stopper based on the original description for FIGS. 1-7 is a unitary assembly that has a common longitudinal axis at all times while assembled. This unitary assembly according to FIG. 5 and including a strainer such as in FIG. 3 includes a cap, a cap seal engaged with the cap, an open-close mechanism having an upper end attached to the cap, a disc attached to the lower end of the open-close mechanism and a drain seal engaged with the disc for sealing an annular space between the disc and an inside wall of a drain pipe. This unitary assembly has a common longitudinal axis at all times while assembled and does not have any hinged portion, such as for tilting the cap out of the way for cleaning the strainer. This unitary assembly, this drain stopper, can be pushed into a drain pipe and can later be pulled out of the drain pipe for cleaning the strainer while maintaining a common longitudinal axis and without any disassembly from the drain pipe such as unthreading from a set of crossbars in a bathtub drain pipe or removal of a pivot rod in a bathroom sink drain pipe.

The drain stopper described with reference to FIG. 5 can also be used in a drain pipe that has crossbars with the disc 56 resting on the crossbars. This may be the more typical use for the embodiment of FIG. 5, as bathtub drain pipes generally have crossbars. For a drain stopper with a strainer, the drain seal 56 would provide a seal between the disc 56 and an inside surface of a drain pipe, which would force water to drain through the strainer. If the drain stopper is intended to rest on crossbars, it would not be necessary to design the drain stopper to be held in place entirely by friction between the drain seal and the inside surface of the drain pipe. A preferred embodiment of a drain stopper for resting on, but not being attached to, crossbars includes the adjustable-height feature, where the open-close mechanism can be screwed into or onto the cap a variable amount to adjust the length of the drain stopper, preferably further including the lock nut 24. In this application, the drain stopper can very easily be pushed into the drain pipe until it contacts the crossbars, and it can be pulled out as a unitary assembly for cleaning a strainer without unthreading the drain stopper from the crossbars (no disassembly required).

Figure 8:
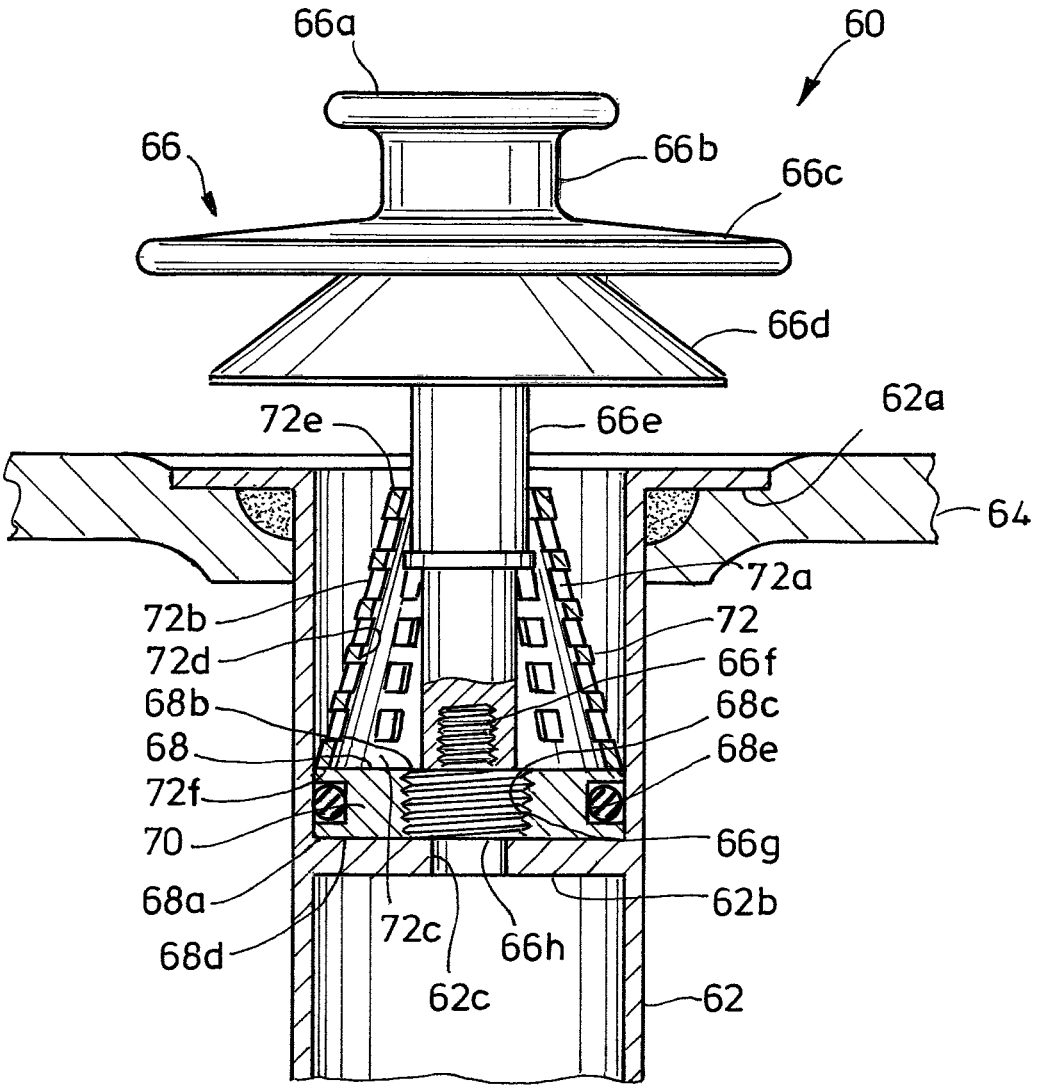
FIG. 8 is a side elevation in partial cross-section of a drain stopper assembly, according to the present invention.

FIG. 8 is a side elevation in partial cross-section of a bathtub drain assembly 60, which is made and used as described with reference to FIGS. 1, 2, 3 and 5 A drain pipe 62 has a drain flange 62*a* sealed about a drain opening in a bathtub 64. A crossbar 62*b* is fixed inside the drain pipe 62. The crossbar 32*b* has a central threaded opening 62*c*. Crossbars 62*b* are preferably formed integral with the drain pipe 62 and are preferably not fastened inside the drain pipe 62 by a friction or interference fit. A drain stopper 66 includes a cap 66*a*, which has a grip portion 66*b*, a large and decorative drain cover 66*c*, a cap seal 66*d*, which seals against the drain flange 62*a*, an open-close mechanism 66*e* and possibly, but not necessarily, a lock nut as shown in FIG. 1, but not visible in FIG. 8. The open-close mechanism 66*e* has the same male threads on an upper end and is threaded into the cap for adjusting height in the same manner as described for the stopper 10 in FIG. 1. The open-close mechanism 66*e* also may have the threaded bore 66*f* at its lower end, which is the same as the bore 22*c* in FIG. 1 and exterior threads 66*g* on a lower end 66*h*. A disc 68 has a shape the same as or similar to the disc 56 in FIGS. 5 and 6. Disc 68 has an outer ring 68*a*, central hub 68*b*, which has a threaded opening 68*c*, and spokes 68*d* extend between the outer ring 68*a* and the central hub 68*b*. Disc 68 has a groove 68*e* along its circumference or perimeter, and an O-ring or drain seal 70 is received in the groove 68*e* for sealing an annular space between the disc 68 and an inside wall of the drain pipe 62. Disc 68 is threaded onto the lower end 66*h* of the open-close mechanism 66*e* with the exterior threads 66*g* on the lower end 66*h* of the open-close mechanism 66*e* engaged with the interior threads 68*c* of the central hub 68*b*. Disc 68 can be attached to the open-close mechanism 66*e* as illustrated in FIG. 5 or as illustrated in FIG. 8. Water can flow through the disc 68 and the crossbars 62*b*. Disc 68 can be a perforated disc that functions as a strainer.

In the embodiment of FIG. 8, a strainer 72 surrounds the open-close mechanism 66*e* and has a plurality of holes 72*a* sized and designed to allow water to pass from an outside surface 72*b* to an inside space 72*c* defined between an inside surface 72*d* of the strainer 72 and the open-close mechanism 66*e*. Strainer 72 has a smaller diameter upper end 72*e* relative to a larger diameter lower end 72*f*. Hair, debris and objects tend to be caught on the outside surface 72*b* of the strainer 72 while water passes through the holes 72*a*. The inside diameter of the upper end 72*e* of the strainer is only slightly larger than an outside diameter of the open-close mechanism 66*e*, which allows the open-close mechanism 66*e* to move up and down within the upper end 72*e* of the strainer 72 while tending to prevent hair, debris or objects from flowing into the inside space 72*c*. Although not shown in the drawings, the strainer 72 preferably further includes a centralizing structure for holding the drain stopper 66 in an upright, central position in the drain flange 62*a*. A centralizing structure may include a set of prongs such as described for FIGS. 20-23 in the present inventors' U.S. patent application Ser. No. 16/558,262 filed on Sep. 2, 2019. The strainer 72, regardless whether oriented as shown in FIG. 3 or as shown in FIG. 8, has one end that has an outside diameter that is approximately the same or slightly larger than the inside diameter of the drain pipe 62, thereby tending to seal against the inside surface of the drain pipe. The other end of the strainer 72 is preferably designed and sized to somewhat seal against the open-close mechanism 66*d*, while allowing the open-close mechanism to slide up and down. The strainer basket 40 in FIG. 3 has an enclosed lower end that has holes for straining out hair, debris and objects and a central opening for receiving the lower end of the push mechanism 36*e* in a fit that is sufficiently snug to tend to prevent hair, debris and objects from passing through an annular space between the outside surface of the push mechanism and an inside surface that defines the central opening in the lower end of the strainer basket 40. Strainer 72 and strainer basket 40 can be said to have a frustoconical shape or the shape of a cone in which the pointed end of the cone has been cut off perpendicular to the longitudinal axis of the cone. The strainer of the present invention preferably does not have side walls that lie parallel to the inside wall of the drain pipe in which it is installed. The strainer of the present invention is preferably not visible to a person using a bathtub in which the drain stopper of the present invention is installed.

Disc 68 rests on the crossbars 62*b* in the drain pipe 62. Strainer 72 rests on the disc 68. Drain stopper 66 is a unitary assembly that includes the cap 66*a*, the cap seal 66*d*, the open-close mechanism 66*e*, the drain seal 70 and preferably includes straining functionality such as provided by using a perforated disc for disc 68 or a strainer basket such as strainer basket 40 in FIG. 3 or strainer 72 in FIG. 8. Drain stopper 66 can be pushed into and can be pulled out of the drain pipe 62. Drain stopper 66 rests on the crossbars 62*b*, so the drain stopper does not need to be unthreaded from the crossbars, meaning no disassembly is required to pull the drain stopper 66 out of the drain pipe 62 for cleaning or replacing the strainer 72. Drain stopper 66 is not attached to the crossbars 62*b*, unlike prior art drain stoppers that are threadedly connected to crossbars in a bathtub drain pipe, which is often called a tub shoe. The strainer 72 can have a hinged seam and locking detent mechanism for removal from the open-close mechanism 66*e*, but one may prefer to unscrew the disc 68 from the open-close mechanism 66*e* for removing and replacing the strainer 72. The open-close mechanism 66*e* can be of any suitable type including a push-push, a lift-and-turn and a lift-and-lock type of open-close mechanism. The open-close mechanism 66*e* is not hinged in any manner for providing access to the strainer 72 because the drain stopper 66 can be easily pulled out of the drain pipe 62. With reference to the present inventors' U.S. Pat. No. 10,301,803, which is incorporated by reference, drain stopper 66 can be used in a pop-up drain assembly in a bathroom sink, where a drain pipe has a pivot rod that protrudes into the drain pipe, where preferably the pivot rod is preferably replaced with a rod that does not pivot, and drain stopper 66 rests on the rod, but is not attached to the rod. U.S. Pat. No. 9,518,383, issued to Lesmeister, discloses a drain assembly that includes a guide rod and a set of magnets for holding the drain assembly in either an open position or a closed position. Drain stopper 66 does not include a guide rod as disclosed in the Lesmeister '383 patent or a magnet to hold the open-close mechanism 66*e* in an open position or in a closed position.

One embodiment of the drain stopper of the present invention preferably does not include any component other than a cap, a cap seal, an open-close mechanism, a disc on the lower end of the open close mechanism, a drain seal engaged with the disc and, preferably a strainer of some type, where the drain stopper is not attached to the drain pipe in which it is installed, and where the drain stopper can be simply pushed into and pulled out of the drain pipe. The cap seal is preferably engaged with the cap and preferably seals against an upper surface of a drain flange on a drain pipe, although the cap seal can seal against an inside wall of the drain pipe. The strainer is either the disc, which is perforated in this case, or a strainer basket located preferably between the disc and the cap. For this embodiment of the drain stopper, the cap, cap seal, open-close mechanism, disc, drain seal and strainer are preferably radially symmetrical about the longitudinal axis of the drain stopper at all times while assembled. The strainer preferably has a frustoconical shape and can be oriented to catch hair, debris and objects on an inside or on an outside surface. Drain stopper 66 is preferably not hinged in any manner for providing access to the strainer. Drain stopper 66 is designed and sized to operate in a standard drain for a bathtub or a sink, where the standard drain includes a drain pipe having a circular cross-section, a flange at an upper end that extends radially from the upper end, which is visible in the bottom of a bathtub or a sink, and which typically includes crossbars, which typically have the shape shown in FIG. 7.

FIG. 9 illustrates another means for anchoring a drain stopper in a drain pipe that has crossbars, which have a central opening. FIG. 9 is a side elevation in partial cross-section of a bathtub drain assembly 80, which is made and used as described with reference to FIGS. 1, 2 and 3. A drain pipe 82 has a drain flange 82*a* sealed about a drain opening in a bathtub 84. A crossbar 82*b* is fixed inside the drain pipe 82. The crossbar 82*b* has a central threaded opening 82*c*. Crossbars 82*b* are preferably formed integral with the drain pipe 82 and are preferably not fastened inside the drain pipe 82 by a friction or interference fit. A drain stopper 86 includes a cap 86*a*, which has a grip portion 86*b*, a large and decorative drain cover 86*c*, which can be sized to cover and hide the drain flange 82*a*, a cap seal 86*d*, which preferably seals against the drain flange 82*a*, an open-close mechanism 86*e* and possibly, but not necessarily, a lock nut as shown in FIG. 1, but not shown in FIG. 9. The cap can instead have a simple dome shape. The open-close mechanism 86*e* has the same male threads on an upper end and is threaded into the cap for adjusting height in the same manner as described for the stopper 10 in FIG. 1. However, this threading arrangement can be reversed in any and all of the embodiments, which would place exterior threads on the cap and interior threads in the open-close mechanism. The open-close mechanism 86*e* preferably has a threaded bore 86*f* at a lower end 86*g*, which is the same as the bore 22*c* in FIG. 1 and may, but does not, have exterior threads on its lower end 86*g*. A rod 88 has a stud 88*a*, which has exterior threads, on an upper end, which is threaded into the threaded bore 86*f* on the lower end 86*g* of the open-close mechanism 86*e*. A lower end 88*b* of the rod 88 has a greater diameter than the stud 88*a* on the upper end.

Rod 88 in FIG. 9 has a central portion 88*c*, which as an outer surface and a cavity 88*d* in the outer surface. The cavity 88*d* is shown in dashed lines. A ball-and-spring detent mechanism 90 is received in the cavity 88*d*. The ball-and-spring detent mechanism 90 comprises a ball 90*a* captured and held in the cavity 88*d* and a spring 90*b* received in the cavity 88*d* between the ball 90*a* and an interior surface 88*e* that defines the cavity 88*d*. Spring 90*b* pushes the ball 90*a* radially outwardly, but the cavity 88*d* is designed and sized to hold the ball 90*b* within the cavity 88*d*. Some deformation allows installation of the spring 90*b* and the ball 90*a* in the cavity 88*d*. The spring 90*b* is preferably a coiled spring. A portion of the ball 90*a* protrudes beyond the outer surface of the rod 88, if there is no opposing force against the spring bias that pushes the ball 90*a* radially outwardly. The lower end 88*b* of the rod 88 has a tapered and pointed portion 88*f* adjacent to a lowermost tip 88*g* of the lower end 88*b* of the rod 88. In another embodiment not shown, the ball-and-spring detent mechanism 90 is built into the lower end of the open-close mechanism 86*e* rather than using the separate rod 88.

The central threaded opening 82*c* in the crossbar 82*b* has an inside diameter, which is typically either three-eighths or five-sixteenths of an inch in the U.S. The lower end 88*b* of the rod 88 in FIG. 9 has a diameter that is slightly less than the inside diameter of the central threaded opening 82*c* in the crossbar 82*b*. FIG. 9 illustrates a central threaded opening 82*c* in the crossbar 82*b* that has a three-eighths inch inside diameter. FIG. 10 illustrates the lower portion of FIG. 9, except the lower end of the rod in FIG. 10 has a diameter that is slightly less than the inside diameter of a central threaded opening in a crossbar that has an inside diameter that is five-sixteenths of an inch. It is preferable to have a ball-and-spring detent mechanism that will operate satisfactorily in either a three-eighths or in a five-sixteenths inch opening and in related metric sizes.

The drain stopper 86 of FIG. 9 comprises a unitary assembly that includes the cap 86*a*, the cap seal 86*d*, the open-close mechanism 86*e*, the rod 88 and the detent mechanism 90. One can insert the tapered portion 88*f* of the rod 88 in the central threaded opening 82*c* in the crossbars 82*b* in the drain pipe 82 and push downwardly. The force of the downward push causes the ball 90*a* in the detent mechanism to move radially inwardly and nearly fully into the cavity 88*e*. After the ball 90*a* passes through the central opening 82*c*, the spring 90*b* pushes the ball 90*a* radially outwardly. The drain stopper 86 is designed and sized and possibly adjusted so that the lower end 86*g* of the open-close mechanism 86*e* abuts and rests on an upper surface of the crossbars 82*b* in the drain pipe 82, while the ball 90*a* in the detent mechanism 90 protrudes radially outwardly from the outer surface of the central portion 88*c* of the rod 88. The detent mechanism 90 holds the drain stopper 86 in the drain pipe 82 because the ball 90*a* engages a lower surface of the crossbars 82*b* or of a central hub in the crossbars that defines the central threaded opening 82*c*, thereby requiring a force to pull the drain stopper 86 out of the drain pipe 82, which causes the ball 90*a* to recede into the cavity 88*d*.

Since the drain stopper 86 is not threaded into the central threaded opening 82*c* in the crossbars 82*b*, an owner can easily pull the drain stopper 86 out of the drain pipe 82 and can easily insert the drain stopper 86 back in the drain pipe 82 with the ball-and-spring detent mechanism 90 holding the drain stopper 86 in place for operation between its open and closed positions. A strainer such as the strainer 40 in FIG. 3 or the strainer 72 in FIG. 8 can be used with the drain stopper 86 in FIG. 9. The easy installation, removal and re-installation of the drain stopper 86 in the drain pipe 82 is particularly beneficial when a strainer is included in the drain stopper assembly because the strainer can be easily cleaned or replaced. The unitary assembly of the drain stopper 86 does not need or have a hinged portion that provides access to the strainer basket, so the unitary assembly of the drain stopper 86 remains radially symmetrical about its longitudinal axis at all times while assembled. The open-close mechanism 86*e* can be a lift-and-lock type or a lift-and-turn type of open-close mechanism, but a push-push type of open-close mechanism is preferred. For a push mechanism, a first push downward on the cap moves the stopper from the open position to the closed position and a subsequent push downward on the cap moves the stopper from the closed position back to the open position. One may prefer a dome-shaped cap with a push-type open-close mechanism. One may prefer a different shape for the cap and an annular seal rather than the frustoconical seal 86*d* in FIG. 9, where the annular seal seals against an inside wall of the drain pipe 82. If one wishes to use the drain stopper 86 in a drain pipe that does not have crossbars, then the disc 56 illustrated in FIG. 5 can be designed, sized and installed in the drain pipe to serve the purpose of the crossbars 82*b* in FIG. 9.

FIG. 11 illustrates another means for anchoring a drain stopper in a drain pipe that has crossbars, which have a central opening. FIG. 11 is a side elevation in partial cross-section of a bathtub drain assembly 100, which is made and used as described with reference to FIGS. 1, 2 and 3. A drain pipe 102 has a drain flange 102*a* sealed about a drain opening in a bathtub 104. A crossbar 102*b* is fixed inside the drain pipe 102. The crossbar 102*b* has a central threaded opening 102*c*. Crossbars 102*b* are preferably formed integral with the drain pipe 102 and are preferably not fastened inside the drain pipe 102 by a friction or interference fit. A drain stopper 106 includes a cap 106*a*, which has a grip portion 106*b*, a large and decorative drain cover 106*c*, which can be sized to cover and hide the drain flange 102*a*, a cap seal 106*d*, which preferably seals against the drain flange 102*a*, an open-close mechanism 106*e* and possibly, but not necessarily, a lock nut as shown in FIG. 1, but not shown in FIG. 11. The cap can instead have a simple dome shape. The open-close mechanism 106*e* has the same male threads on an upper end and is threaded into the cap for adjusting height in the same manner as described for the stopper 10 in FIG. 1. However, this threading arrangement can be reversed in any and all of the embodiments, which would place exterior threads on the cap and interior threads in the open-close mechanism. The open-close mechanism 106*e* preferably has a threaded bore 106*f* at a lower end 106*g*, which is the same as the bore 22*c* in FIG. 1 and may, but does not, have exterior threads on its lower end 106*g*. A strainer such as the strainer 40 in FIG. 3 or the strainer 72 in FIG. 8 can be used with the drain stopper 106 in FIG. 11.

A magnet 108 is formed integral with or is attached to a stud 108*a* that has exterior threads, which is threaded into the threaded bore 106*f* on the lower end 106*g* of the open-close mechanism 106*e*. The magnet 108 can be attached to the lower end 106*g* of the open-close mechanism 106*e* by other means such as by using a press fit, a ratchet-type fit, an adhesive or by being formed integral with the lower end 106*g* of the open-close mechanism 106*e*. Assuming the crossbars 102*b* are made of a non-ferrous stainless steel, a screw 110 that is made of a ferrous material that attracts the magnet 108 is threaded into the central opening 102*c* in the crossbars 102*b*. Screw 110 has a head 110*a* that is attached to a shank 110*b*. Due to magnetic attraction, a bond is formed between magnet 108 and the head 110*a* of the ferrous screw 110, which anchors the drain stopper 106 in the drain pipe 102. FIG. 12 is a side elevation in cross-section that shows a different embodiment of the lower portion of the bathtub drain assembly 100. FIG. 12 illustrates that if the crossbars 102*b* are ferrous and can magnetically bond with the magnet 108 adequately for anchoring, then the screw 110 is not needed. In FIG. 12, the magnet 108 is bonded directly to the crossbars 102*b* because the crossbars are made of a ferrous material that is attracted to the magnet 108.

A number of anchoring systems have been described herein for anchoring or attaching a drain stopper to a drain pipe. The anchoring means include the multiple-prong anchor 20 in FIG. 1, the all-thread rod 38 in FIG. 3, which has one diameter to fit an open-close mechanism and another diameter to fit an opening in a crossbar, the wheel-shaped disc 56 in FIG. 5, which has an O-ring 58 to seal against an inside wall of a drain pipe, the ball-and-spring detent mechanism 90 in FIG. 9, and the magnet 108 in FIG. 11. Since it is desirable to include a strainer with a drain stopper assembly, the preferred anchoring means allow an owner to easily pull a drain stopper out of a drain pipe to clean or replace the strainer and to then easily push the drain stopper assembly back into the drain pipe. The wheel-shaped disc 56 in FIG. 5 can rest on crossbars or can be designed and sized to adequately engage an inside wall of a drain pipe that does not have crossbars, so disc 56 is one means for anchoring a drain stopper in a drain pipe that allows an owner to easily pull the drain stopper assembly out of a drain pipe and to simply push the drain stopper assembly back into the drain pipe. A drain stopper assembly with the ball-and-spring detent mechanism 90 shown in FIG. 9 is another means for anchoring a drain stopper in a drain pipe that allows an owner to easily pull the drain stopper assembly out of and to push the drain stopper assembly into the drain pipe. A magnetic anchoring system such as the magnet 108 described with reference to FIGS. 11 and 12 is another design that provides easy installation and easy removal and re-installation of a drain stopper assembly in a drain pipe. A push-type open-close mechanism works particularly well with the designs that allow the drain stopper assembly to be pushed in and pulled out of a drain pipe without any assembly or disassembly, such as is required for the prongs 20 in FIG. 1 and the threading and unthreading required for the anchor 38 in FIG. 3.

The present invention provides in one embodiment a drain stopper for a bathtub having a drain opening and a drain pipe having crossbars and a drain flange attached to the bathtub at the drain opening. The drain stopper comprises a cap having a bore; a cap seal engaged with the cap for providing a seal with the drain flange or the drain pipe; an open-close mechanism having open and closed positions and upper and lower ends, wherein the upper end is received in the bore of the cap, and wherein cap and the open-close mechanism are designed for the open-close mechanism to be received in the bore a variable amount for adjusting a length between the cap and the lower end of the open-close mechanism; a lock nut engaged with the upper end of the open-close mechanism for fixing the length after adjustment by pressing against, wherein the cap, the cap seal, the open-close mechanism and the lock nut are connected together to form a unitary assembly, and a means for engaging the unitary assembly with the drain pipe selected from the group consisting of a disc designed to rest on the crossbars for holding the unitary assembly in the drain pipe, a ball-and-spring detent mechanism designed to engage the unitary assembly with the crossbars and a magnet designed to engage the unitary assembly with the crossbars. The unitary assembly preferably includes a strainer basket surrounding the open-close mechanism below the cap seal while in operation. The unitary assembly is not threadedly engaged with the drain pipe and is simply pushed into the drain pipe for engagement with the drain pipe and is simply pulled out of the drain pipe for cleaning or replacing the strainer basket. Consequently, an owner can push the unitary assembly into the drain pipe and operate the unitary assembly to change the open-close mechanism between the open and closed positions and can pull the unitary assembly out of the drain pipe without any disassembly from the drain pipe other than the pull on the unitary assembly. The open-close mechanism is preferably a push-push type of open-close mechanism.

In another embodiment, a drain stopper for a bathtub or a sink having a drain hole and a drain pipe having a drain flange attached to the bathtub at the drain opening, wherein the drain pipe may or may not have crossbars for anchoring the drain stopper, wherein the crossbars may or may not have a central opening, and wherein the central opening may have one of more than one size, comprises: an open-close mechanism having a longitudinal axis, upper and lower ends, a distance between the upper and lower ends and an open position and a closed position, wherein the open-close mechanism is a push mechanism, a lift-and-lock mechanism or a lift-and-turn mechanism, and wherein the distance between the upper end and the lower end differs between the open position and the closed position; a cap engaged with the upper end of the open-close mechanism; a cap seal engaged with the cap for retaining water in the bathtub or the sink while the open-close mechanism is in the closed position; means for engaging the open-close mechanism with the drain pipe, wherein the means is secured to or formed integral with the lower end of the open-close mechanism; and a strainer surrounding the open-close mechanism between the cap and the means, wherein the strainer is inside the drain pipe while the drain stopper is installed in the drain pipe, wherein the open-close mechanism, the cap, the cap seal, the strainer and the means for engaging the open-close mechanism with the drain flange form a unitary assembly while assembled, wherein the unitary assembly has a longitudinal axis that is coaxial with the longitudinal axis of the open-close mechanism at all times while assembled, wherein the unitary assembly is radially symmetrical about the longitudinal axis of the open-close mechanism at all times while assembled, wherein the means for engaging the open-close mechanism with the drain pipe allows the unitary assembly to be pushed into the drain pipe and to be pulled out of the drain pipe without any assembly with or disassembly from the drain pipe.

Drain stoppers according to the present invention can be packaged and sold as kits. One kit for a drain stopper for a bathtub or a sink having a drain hole and a drain flange attached to the bathtub or the sink at the drain hole comprises an open-close mechanism having upper and lower ends, an open position and a closed position, wherein the open-close mechanism is a lift-and-lock mechanism; a cap engaged with the upper end of the open-close mechanism, wherein a push downwardly on the cap moves the open-close mechanism from the open position to the closed position and a subsequent pull upwardly on the cap moves the open-close mechanism from the closed position to the open position; a cap seal engaged with the cap for providing a seal with the drain flange; a strainer having a central opening; and alternative means for engaging the open-close mechanism with the drain flange. A first alternative means is a disc or a body and a drain seal engaged with the disc or the body, wherein the disc or the body is in a direct or an indirect engagement with the lower end of the open-close mechanism, wherein the disc or the body has one or more openings through which water can flow, wherein the drain seal is sized and designed to contact an inside wall of the drain pipe, and wherein the strainer is located between the upper end of the open-close mechanism and the disc or the body. A second alternative means is a rod having threads and opposing ends, and wherein one end is for engaging the open-close mechanism and the other end is for engaging a cross bar in the drain flange.

Another kit for a drain stopper for a bathtub or a sink having a drain hole and a drain flange attached to the bathtub or the sink at the drain hole comprises an open-close mechanism having a longitudinal axis, upper and lower ends, an open position and a closed position, wherein the open-close mechanism is a lift-and-turn mechanism; a cap engaged with the upper end of the open-close mechanism, wherein rotating the cap in one direction moves the open-close mechanism from the open position to the closed position and subsequently lifting and rotating the cap in the opposite direction moves the open-close mechanism from the closed position to the open position; a cap seal engaged with the cap for providing a seal with the drain flange; a strainer having a central opening; and alternative means for engaging the open-close mechanism with the drain flange. A first alternative means is a disc or a body and a drain seal engaged with the disc or the body, wherein the disc or the body is in a direct or an indirect engagement with the lower end of the open-close mechanism, wherein the disc or the body has one or more openings through which water can flow, wherein the drain seal is sized and designed to contact an inside wall of the drain pipe, and wherein the strainer is located between the upper end of the open-close mechanism and the disc or the body. A second alternative means is a rod having threads and opposing ends, and wherein one end is for engaging the open-close mechanism and the other end is for engaging a cross bar in the drain flange.

Having described the invention above, various modifications of the techniques, procedures, materials, and equipment will be apparent to those skilled in the art. It is intended that all such variations within the scope and spirit of the invention be included within the scope of the appended claims.

What is claimed is:

1. A drain stopper for a bathtub or a sink having a drain hole and a drain pipe having a drain flange attached to the bathtub or sink at the drain opening, wherein the drain pipe may or may not have crossbars for anchoring the drain stopper, wherein the crossbars may or may not have a central opening, and wherein the central opening may have one of more than one size, the drain stopper comprising:

an open-close mechanism having a longitudinal axis, upper and lower ends, a distance between the upper and lower ends and an open position and a closed position, wherein the open-close mechanism is a push mechanism, a lift-and-lock mechanism or a lift-and-turn mechanism, and wherein the distance between the upper end and the lower end differs between the open position and the closed position;

a cap engaged with the upper end of the open-close mechanism;

a drain seal engaged with the cap or the open-close mechanism for retaining water in the bathtub or the sink while the open-close mechanism is in the closed position;

means for engaging the open-close mechanism with the drain pipe, wherein the means is secured to or formed integral with the lower end of the open-close mechanism; and a strainer surrounding the open-close mechanism, wherein the strainer is entirely inside the drain pipe and above the means for engaging the open-close mechanism with the drain pipe while in operation, wherein the open-close mechanism, the cap, the drain seal, the strainer and the means for engaging the open-close mechanism with the drain flange form a unitary assembly while assembled, wherein the unitary assembly has a longitudinal axis that is coaxial with the longitudinal axis of the open-close mechanism at all times while assembled, wherein the unitary assembly is radially symmetrical about the longitudinal axis of the open-close mechanism at all times while assembled, and wherein the means for engaging the open-close mechanism with the drain pipe is designed and configured to allow a user to push the unitary assembly into the drain pipe and to pull the unitary assembly out of the drain pipe without requiring any assembly or disassembly.

2. The drain stopper of claim 1, wherein the unitary assembly is not threadedly engaged with the drain pipe, and wherein the user can pull the unitary assembly out of the drain pipe without rotating the unitary assembly and without rotating any portion of the unitary assembly.

3. The drain stopper of claim 1, wherein the means for engaging the open-close mechanism with the drain pipe comprises a wheel-shaped disc and an annular seal engaged with the disc, and wherein the disc is designed and configured to rest on the crossbars in the drain pipe without attachment to the crossbars.

4. The drain stopper of claim 1, wherein the means for engaging the open-close mechanism with the drain pipe comprises a ball-and-spring detent mechanism attached to or formed integral with the lower end of the open-close mechanism, wherein the ball-and-spring detent mechanism is designed and configured to pass through the central opening in the crossbars and for the ball to move radially outwardly after passing through the central opening for engaging the drain stopper with the drain pipe.

5. The drain stopper of claim 1, wherein the means for engaging the open-close mechanism with the drain pipe comprises a magnet that is designed and configured so that the drain stopper is engaged with the crossbars in the drain pipe through magnetic attraction.

6. The drain stopper of claim 5, wherein the open-close mechanism has a bore defined by interior threads on its lower end, wherein the magnet comprises a shank and a head attached to the shank, and wherein the shank has exterior threads engaged with the interior threads.

7. A drain stopper for a bathtub or a sink having a drain hole and a drain pipe having a drain flange attached to the bathtub or the sink at the drain hole, the drain stopper comprising:

an open-close mechanism having upper and lower ends, a distance between the upper and lower ends and an open position and a closed position, wherein the open-close mechanism is a push mechanism, a lift-and-lock mechanism or a lift-and-turn mechanism, wherein the lower end has threads, and wherein the distance between the upper end and the lower end differs between the open position and the closed position;

a disc or a body in a direct or an indirect engagement with the lower end of the open-close mechanism, wherein the disc or the body has one or more openings through which water can flow;

an annular seal engaged with the disc or body for providing a seal between the disc or the body and the drain pipe;

a cap engaged with the upper end of the open-close mechanism;

a drain seal engaged with the cap or the open-close mechanism for retaining water in the bathtub or the sink; and a strainer surrounding the open-closed mechanism between the drain seal and the disc or body, wherein the strainer has an opening through which the lower end of the open-close mechanism projects, and wherein the strainer is entirely inside the drain pipe while in operation, wherein the open-close mechanism, the disc or the body, the drain seal, the cap and the strainer comprise a unitary assembly, wherein the unitary assembly is not designed or configured for a threaded engagement with the drain pipe, and wherein the unitary assembly is designed and configured to be pushed into engagement with the drain pipe and to be pulled out of engagement with the drain pipe without requiring any assembly or disassembly.

8. The drain stopper of claim 7, wherein the strainer is a strainer basket, wherein the strainer basket has a base with a central opening for receiving the lower end of the open-close mechanism, an opposing end that is open and a side wall attached to the base that flares outwardly from the base, wherein the sidewall and the base have openings for water to flow through, and wherein the strainer basket can be oriented to catch hair on an inside surface of the strainer basket or on an outside surface of the strainer basket, and wherein the disc or the body retains the strainer on the open-close mechanism.

9. The drain stopper of claim 7, wherein the disc or the body is a perforated disc.

10. The drain stopper of claim 7, wherein:

the upper end of the open-close mechanism has exterior threads, the cap has a bore defined by female threads, the upper end of the open-close mechanism is received in the bore of the cap, the drain stopper has a length between the cap and the lower end of the open-close mechanism, and the length can be adjusted by the amount that the upper end of the open-close mechanism is screwed into the bore in the cap; further comprising a lock nut having interior threads received on the upper end of the open-close mechanism, wherein the lock nut is designed and configured to provide a tight friction abutment with the cap for holding the length of the drain stopper constant.

11. The drain stopper of claim 7, wherein the open-close mechanism is a push mechanism.

12. The drain stopper of claim 7, wherein the unitary assembly is designed and configured to rest on crossbars in the drain pipe, and wherein the unitary assembly is not designed or configured to be attached to the crossbars.

13. The drain stopper of claim 7, wherein the open-close mechanism is a push mechanism, wherein the strainer is a strainer basket that does not have a radially-outwardly-extending flange, wherein the unitary assembly is designed and configured to rest on crossbars that are fixed in the drain pipe, and wherein the unitary assembly is not designed or configured to be attached to the crossbars, thereby providing a push-in, pull-out drain stopper assembly.

* * * * *